United States Patent [19]

Fajt

[11] 4,262,651

[45] Apr. 21, 1981

[54] FIREPLACE LOG GUARD

[76] Inventor: Jr. Fajt, 2149 Iris Rd., Pueblo, Colo. 81006

[21] Appl. No.: 96,613

[22] Filed: Nov. 23, 1979

[51] Int. Cl.[3] ..... F24C 15/36

[52] U.S. Cl. ..... 126/202; 126/152 B; 126/164

[58] Field of Search ..... 126/152 A, 152 B, 164, 126/165, 163 A, 163 B, 201, 202, 203, 298, 25 A

[56] References Cited

U.S. PATENT DOCUMENTS

| | | | |
|---|---|---|---|
| 355,565 | 1/1887 | Sheeran | 126/202 |
| 944,980 | 12/1909 | Yarborough | 126/298 |

FOREIGN PATENT DOCUMENTS

| | | | |
|---|---|---|---|
| 27568 | of 1903 | United Kingdom | 126/202 |
| 106252 | of 1904 | United Kingdom | 126/202 |
| 451727 | 11/1936 | United Kingdom | 126/202 |

*Primary Examiner*—James C. Yeung

[57] ABSTRACT

A bolt action vertically adjustable log guard attachable to the front of a fireplace grate and including a horizontally disposed frame bar with spaced parallel legs depending therefrom so that, when elevated above the grate, the legs will retain logs and other fuel thereon, and, in lowered position, will enable the grate to be cleaned and logs positioned thereon.

4 Claims, 4 Drawing Figures

FIREPLACE LOG GUARD

BACKGROUND OF THE PRESENT INVENTION

This invention relates to fireplace log guard.

While various log retaining devices associated with fireplaces have heretofore been proposed, such as those of U.S. Patents to Stephenson U.S. Pat. No. 2,050,591, Waggoner U.S. Pat. No. 2,446,894, Egli U.S. Pat. No. 4,010,729, and Cranberg 4,069,808, none thereof includes a vertically adjustable front mounted guard which retains logs thereon when in elevated operable position and enables cleaning of the grate and positioning of logs thereon when lowered.

SUMMARY OF THE INVENTION

The principal object of the present invention is to provide a vertically adjustable log guard attachable to the front of a fireplace grate and including a horizontally disposed frame bar with spaced parallel legs depending therefrom so that, when elevated above the grate, the legs will retain logs and other fuel thereon, and, in lowered position, will enable the grate to be cleaned and logs positioned thereon.

Another object is the provision of a vertically adjustable log guard including a horizontally disposed frame bar with spaced curved depending legs arranged on a bolt slidable within a sleeve attached to the front of the grate, and wherein a pin on the bolt is vertically slidable in a slot in the sleeve formed with a locking offset at its upper end whereby the log guard may be elevated and locked by the pin above the grate in log retaining position, and lowered therebelow into inoperative cleaning and loading position.

A further object is to provide a log guard wherein the bolt supporting sleeve is attachable to the front of the fireplace grate approximately in the center thereof and engages with the fireplace floor so as to stabilize the grate when extra heavy logs are placed thereon.

These and other objects and advantages will be apparent as the specification is considered with the accompanying drawings, wherein FIG. 1 is a perspective view of a grate and attached log guard positioned in a fireplace;

DETAILED DESCRIPTION

Figure 1:
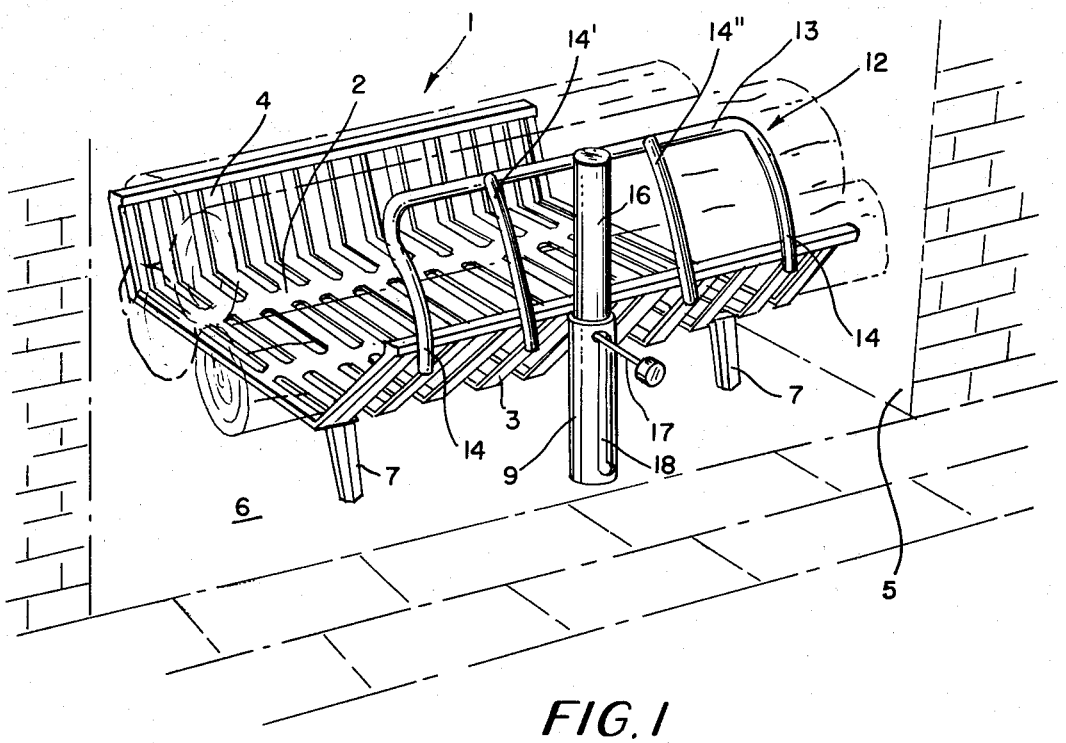

Referring more particularly to the drawings, wherein similar reference characters designate like parts throughout the several views, numeral 1 identifies a generally conventional log and other fuel supporting metal grate having a slotted bottom 2 and upwardly and outwardly sloping front 3 and rear walls 4, and open at its ends. The grate is supported above the floor 6 by the usual corner legs 7.

Suitably fixedly attached to the upper end portion of the front wall 3 and intermediate the ends thereof, as at 8, such as by welding or the like not shown, is the open upper end 10 of an elongated tubular metal sleeve 9. The latter is of a length to reach and abut the floor 6 so as to stabilize the grate and prevent forward tipping thereof when extra heavy logs 11 are placed thereon.

A metal log guard 12 ncludes a horizontally disposed frame bar 13 which is bent downwardly at its opposing ends to form depending legs or prongs 14, curved or bowed, as at 15. At least two other correspondingly curved or bowed legs 14' and 14'' are suitably fixedly attached to bar 13, by welding or the like not shown, in equally spaced and parallel relation with respect to each other and the end legs 14.

Arranged in the center of bar 13 and suitably fixedly secured thereto intermediate the legs 14'–14'', by welding or the like not shown, is a metal bolt 16 which depends downwardly at right angles therefrom generally parallel to the legs. The bolt 16 is snugly but slidably sleeved within sleeve 9 and is provided with a relatively short radially extending knobbed actuating pin 17, adjacent its lower end, which projects through and is seated within an elongated slot 18 extending from a point adjacent the lower end of the sleeve to a point adjacent the upper end thereof. A latterly extending locking offset 19 is formed at the upper terminus of slot 18 so that, as the knobbed pin 17 is slid vertically of the slot to move the bolt upwardly and downwardly, for a purpose presently to be described, to the elevated log guarding and lowered inactive positions, relative to sleeve 9 and grate 1, the pin may be disposed therein to retain the log guard in the former position, in an obvious manner.

Figure 2:
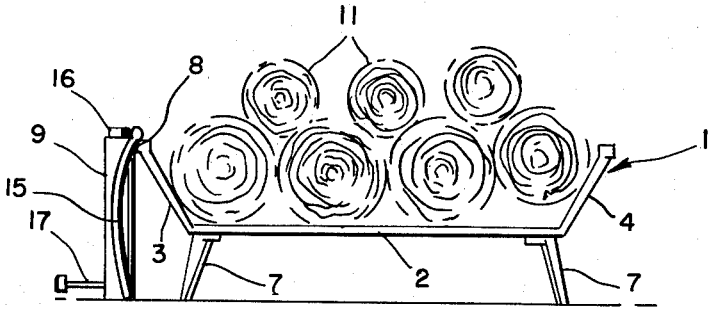
FIG. 2 is an end elevation of the interconnected log loaded grate and log guard, with the latter in lowered inoperative position.
Figure 3:
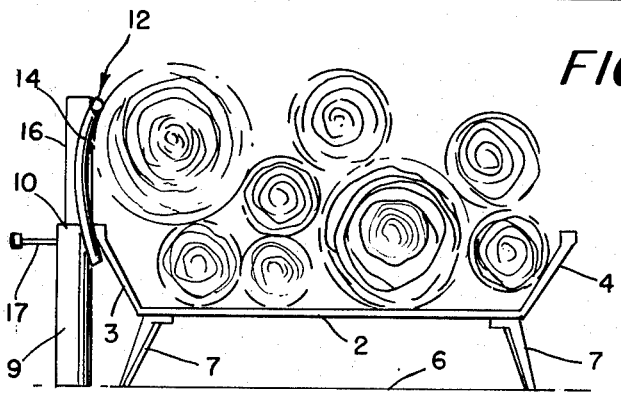
FIG. 3 is an end elevation of the interconnected log loaded grate and log guard, with the latter in elevated locked log retaining position.
Figure 4:
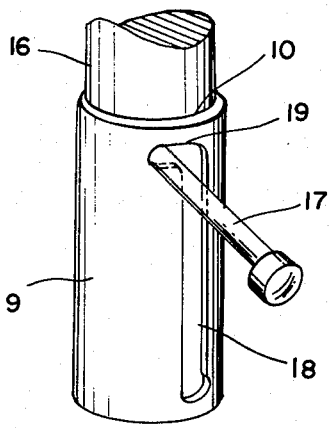
FIG. 4 is a perspective view of the log guard supporting bolt and sleeve, with the actuating pin in locked elevated position.

From the foregoing, and as will be apparent from FIGS. 1 and 2, when it is desired to clean the grate and arrange logs thereon, the bolt 16 and log guard 12 is unlatched and dropped downwardly in sleeve 9 to the FIG. 2 position, where the frame bar 13 abuts the upper end portion of the front grate wall and the legs and prongs thereof project therebelow so as to afford easy access to the grate. When the logs are burning and safety requires their being prevented from becoming dislodged therefrom, the knobbed pin 17 of the bolt is grasped and the latter slid to the upper end of the sleeve 9 and the pin moved latterly into the locking offset 19, at which time the log guard will be elevated to the positions of FIGS. 1 and 3 where the frame bar 13 and legs 14'–14'' thereof will be positioned in front and act as a barrier in preventing the logs tumbling off during burning.

While a preferred embodiment of combined grate and log guard has been shown and described, it is to be understood that various changes and improvements may be made therein without departing from the scope and spirit of the appended claims.

What I claim is:

1. In a fireplace grate having a bottom wall for supporting logs and upturned front and rear walls, a log guard comprising a vertically disposed elongated sleeve member fixedly attached to said front wall generally in the center of and depending therefrom, said sleeve member engaging a supporting surface for stabilizing said grate and preventing forward toppling thereof, a horizontally disposed guard frame bar formed with downwardly depending spaced leg means, said bar having a generally centrally disposed vertical bolt means spaced from said leg means, said bolt means being sleeved and vertically movable in said sleeve member, locking means formed on said sleeve member for latching said bolt means therein, said bolt means and bar being elevatable above said front grate wall whereby said spaced legs act as a barrier to logs on said grate, and when lowered below the top of said front wall said grate is accessible for cleaning and loading.

2. In a log guard, according to claim 1, wherein said leg means are bowed, and are arranged parallel, and wherein said bar is bent downwardly at its opposing ends to form the endmost of said leg means.

3. In a log guard, according to claim 1, wherein at least two leg means are fixedly secured to said frame bar and depend downwardly theefrom in spaced parallel arrangement with each other and said endmost leg means.

4. In a log guard, according to claim 1, wherein said sleeve member is longitudinally slotted, radially projecting pin means on said bolt means extending through and slidable within said sleeve member slot for vertically elevating and lowering said bolt and log guard relative to said grate, and wherein the upper end of said slot is offset and said pin means is disposable therein for latching and retaining said bolt and log guard in elevated log retaining position.

* * * * *

UNITED STATES PATENT AND TRADEMARK OFFICE

CERTIFICATE OF CORRECTION

PATENT NO. : 4,262,651

DATED : April 21, 1981

INVENTOR(S) : Robert Fajt, Jr.

It is certified that error appears in the above—identified patent and that said Letters Patent is hereby corrected as shown below:

On the Title Page the inventor's name should read

-- Robert Fajt, Jr. --.

Signed and Sealed this

*Eighteenth* Day of *August 1981*

[SEAL]

*Attest:*

GERALD J. MOSSINGHOFF

*Attesting Officer*

*Commissioner of Patents and Trademarks*